US006516755B2

(12) United States Patent
Gregory

(10) Patent No.: US 6,516,755 B2
(45) Date of Patent: Feb. 11, 2003

(54) COOLING CIRCUIT FOR AN INTERNAL COMBUSTION ENGINE

(75) Inventor: Jens von Gregory, Remshalden (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/945,439

(22) Filed: Sep. 1, 2001

(65) Prior Publication Data

US 2002/0043223 A1 Apr. 18, 2002

(30) Foreign Application Priority Data

Sep. 5, 2000 (DE) ..... 100 43 618

(51) Int. Cl.[7] ..... F01P 7/14
(52) U.S. Cl. ..... 123/41.1; 123/41.08
(58) Field of Search ..... 123/41.1, 41.08

(56) References Cited

U.S. PATENT DOCUMENTS 4,332,221 A * 6/1982 Imhof et al. ..... 123/41.08
4,425,878 A * 1/1984 Samuel ..... 123/41.08
5,121,714 A * 6/1992 Susa et al. ..... 123/411

FOREIGN PATENT DOCUMENTS

DE 197 41 861 4/1999
SU 2027882 C1 * 2/1990 ..... F02B/53/00

* cited by examiner

*Primary Examiner*—Marguerite McMahon
(74) *Attorney, Agent, or Firm*—Klaus J. Bach

(57) ABSTRACT

In a cooling circuit for an internal combustion engine including a cylinder block with a cylinder head wherein the cooling circuit includes a coolant pump with a coolant duct extending from the pump to the engine for supplying coolant thereto, the coolant duct includes a valve arranged between the coolant pump and the engine for controlling the flow of coolant through the coolant duct to the engine.

7 Claims, 1 Drawing Sheet

COOLING CIRCUIT FOR AN INTERNAL COMBUSTION ENGINE

BACKGROUND OF THE INVENTION

The invention relates to a cooling circuit for an internal combustion engine of a vehicle including an engine block with at least one cylinder head to which coolant is supplied from a coolant pump by way of a coolant pipe.

DE 197 41 861 A1 discloses a cooling circuit for an internal combustion engine wherein the cooling water flow through the internal combustion engine is controlled by a thermostatic valve which is arranged in the cooling circuit in flow direction after the internal combustion engine.

A similar cooling circuit is shown in DE 195 06 935 C1.

Both of these cooling circuits however have the disadvantage that, in spite of relatively involved switching arrangements and other efforts, there is only insufficient waste heat available to a heater for heating the interior of the vehicle during the engine warm-up period.

It is therefore the object of the present invention to provide a cooling circuit for an internal combustion engine with which the internal combustion engine reaches operating temperatures more rapidly that is the coolant flowing through the heater connected to the engine for heating the vehicle interior is rapidly heated for heating the vehicle interior.

SUMMARY OF THE INVENTION

In a cooling circuit for an internal combustion engine including a cylinder block with a cylinder head wherein the cooling circuit includes a coolant pump with a coolant duct extending from the pump to the engine for supplying coolant thereto, the coolant duct includes a valve arranged between the coolant pump and the engine for controlling the flow of coolant through the coolant duct to the engine.

With the valve arranged between the coolant pump and the internal combustion engine, it is easy to control the coolant volume flow through the internal combustion engine.

It is for example possible with the valve arrangement according to the invention to keep the coolant duct fully closed while the internal combustion engine is cold so that no coolant is supplied to the internal combustion engine and the coolant disposed in the engine is rapidly heated. When the coolant is sufficiently heated the valve can be opened so that the coolant can circulate in the normal manner.

It is also possible to adjust the valve to provide a certain coolant volume flow through the coolant duct to the engine.

The coolant flow through the engine can be accurately and finely controlled if, as in a preferred embodiment of the invention, the valve includes a closure element for blocking the coolant flow and the closure element is under full control of an operating mechanism with a control device.

Advantageous embodiment of the invention will become apparent from the following description on the basis of the accompanying drawings.

DESCRIPTION OF PREFERRED EMBODIMENTS

Figure 1:
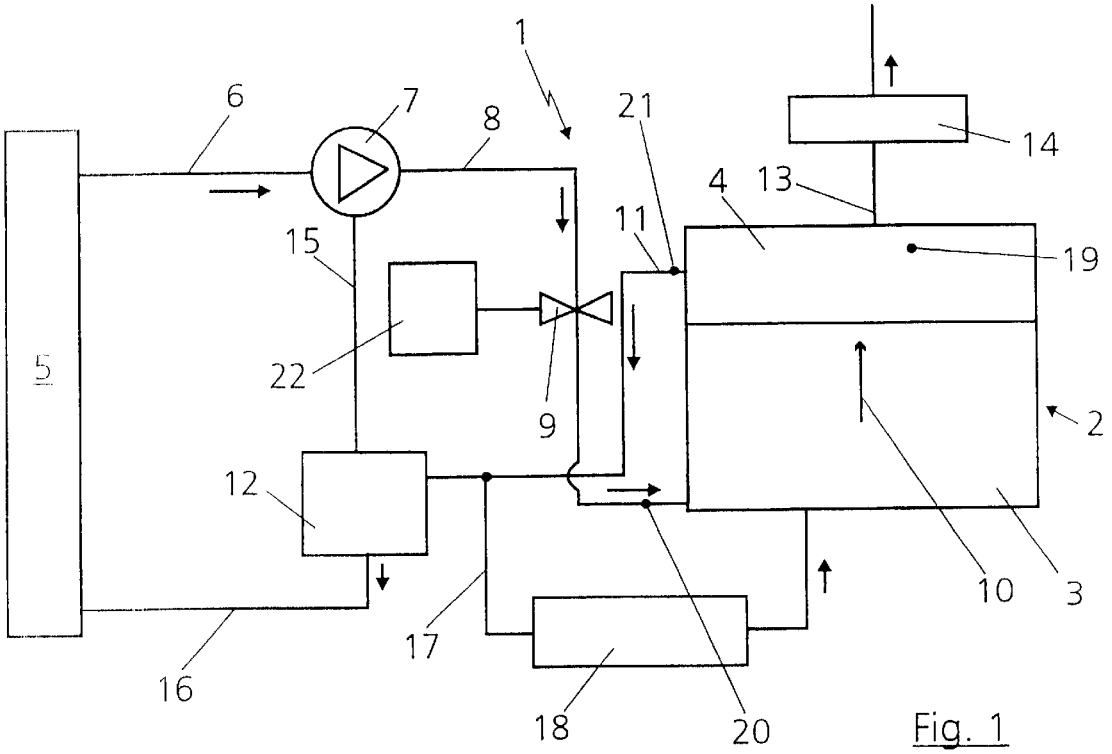
FIG. 1 shows schematically the engine cooling circuit according to the invention.

FIG. 1 shows a cooling circuit 1 for an internal combustion engine 2 comprising an engine block 3 on which a cylinder head 4 is disposed. The cooling circuit 1 includes the following: a duct, 6 which extends from a cooler 5 to a coolant pump 7 from which a coolant duct 8 extends to the engine block 3. The coolant duct 8 includes a valve 9 whose function will be explained later. The coolant reaching the engine block 3 by way of the coolant duct 8 (for example cooking water) can enter the cylinder head 4 as indicated by the arrow 10. It leaves the cylinder head 4 through a coolant return line 11 toward thermostat 12 or through a line 13 to an exhaust gas re-circulation cooler 14. It would of course also be possible to supply the coolant to the cylinder head 4 of the internal combustion engine 2 and to return it from the engine block 3. However, the arrangement as shown in FIG. 1 is considered to be the thermally better solution.

The thermostat 12 is in communication with the coolant pump 7 by another line 15, and with the cooler by a line 16. Finally, a line 17, which extends through an engine oil heat exchanger 18 to the engine block 3, branches off the coolant return line 11. The flow direction of the coolant through the lines 6, 8, 11, 13 15, 16 and 17 is clearly indicated by the arrows in FIG. 1.

With the valve 9 as described, the coolant duct 8 which leads to the internal combustion engine 2 can be closed or opened. Also, intermediate valve positions are possible for obtaining a certain volume flow. When the coolant duct 8 is completely blocked no coolant can flow to the internal combustion engine 2 so that the coolant contained in the cylinder head 4 is much more rapidly heated than would be the case with a continuous coolant flow through the cylinder head. A blocking of the coolant duct 8 by the valve 9 is therefore especially appropriate during a cold start of the internal combustion engine 2 since, with the faster heating of the coolant, a faster heating of an interior space of a vehicle in which the internal combustion engine is disposed is achieved.

The temperature of the coolant is sensed by one or several temperature sensors 19, 20 or, respectively, 21 and passed on to a control unit 22 which is connected to the valve 9. When the coolant in the internal combustion engine 2 or in the coolant duct 8 reaches, in the area between the valve 9 and the internal combustion engine 2 or in the coolant return line 11 between the internal combustion engine 2 and the thermostat 12, a certain temperature, a signal is provided by the control unit 22 for controlling the valve 9. The valve 9 can then be so controlled that the volume flow of the coolant in the coolant pipe 8 is adjusted so that, depending on the requirements of the internal combustion engine 2, an appropriate amount of coolant is permitted to flow to the engine block 3 and from there to the cylinder head 4.

Figure 2:
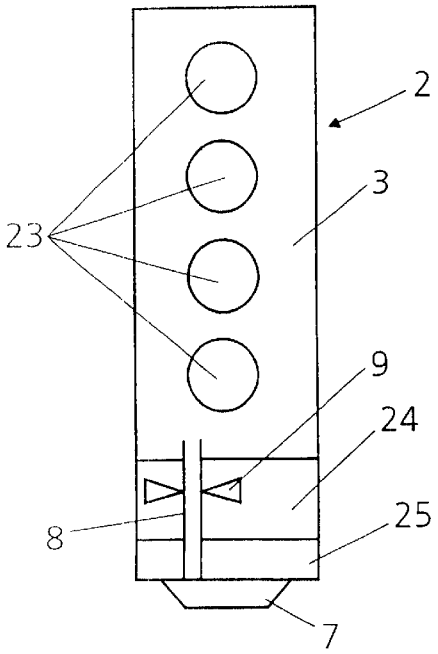
FIG. 2 is a schematic representation showing the arrangement of the coolant pump on the engine.

FIG. 2 shows the engine block 3 of the internal combustion engine with four combustion chambers 23. Of course, the block 3 may have another number of combustion chambers 23. At the front end, the engine block 3 includes a chain casing 24 for containing a camshaft drive chain which, however, is not shown. At its outer side, the chain casing is provided with a chain casing cover 25. Mounted on the chain casing cover 25 is the coolant pump 7. The coolant duct 8 extending through the camshaft drive cover 25 and the drive housing 24 to the engine block 3 is also shown in FIG. 2. Also, the valve 9 is shown again schematically in the coolant duct 8 between the coolant pump 7 and the internal combustion engine 2. In this case, the coolant duct 8 extends through the engine. In the arrangement as shown in FIG. 2, the valve 9 is therefore arranged within the internal combustion engine 2.

Figure 3:
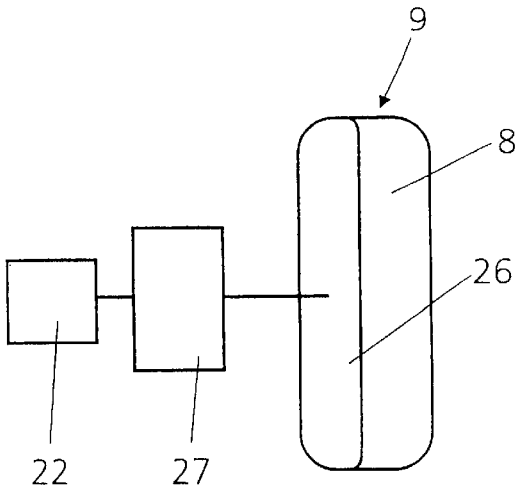
FIG. 3 shows an arrangement for operating a coolant flow control valve.

As shown in FIG. 3, the valve 9 includes a closure element 26 for blocking the coolant duct 8, which is controllable by an operating mechanism 27 connected to the closure element 26. In the arrangement as shown, the closure element 26 is a gate valve, which is capable of fully closing, completely opening or partially opening the coolant duct 8.

The operating mechanism 27 may be for example an electric control motor, a vacuum operator or an electromagnet. As explained earlier the operating mechanism is controlled by the control unit 22.

What is claimed is:

1. A cooling circuit for an internal combustion engine including a cylinder block and a cylinder head mounted on said cylinder block, said cooling circuit including a coolant pump, a coolant duct extending from said coolant pump to said engine for supplying coolant thereto, a controllable gate valve arranged in said coolant duct between said coolant pump and said engine for controlling the volume flow of coolant through said coolant duct to said engine, and a control unit for controlling said controllable gate valve depending on engine operating conditions.

2. A cooling circuit according to claim 1, wherein said controllable gate valve includes a closure element for fully blocking said coolant duct and an operating mechanism for actuating said closure element.

3. A cooling circuit according to claim 1, wherein said coolant duct extends from said coolant pump to said engine block so that coolant is supplied by said pump to said engine block when said controllable gate valve is not closed and said coolant flows from the engine block to the cylinder head and wherein a coolant return line is connected to said cylinder head.

4. A cooling circuit according to claim 2, wherein said operating mechanism is an electric control motor.

5. A cooling circuit according to claim 2, wherein said operating mechanism includes a vacuum operator.

6. A cooling circuit according to claim 2, wherein said operating mechanism includes an electromagnet.

7. A cooling circuit according to claim 1, wherein said coolant pump is mounted directly to said engine, said coolant duct extends from said pump through said engine and said controllable gate valve is arranged within said engine.

* * * * *